United States Patent [19]

Holtermann

[11] 4,304,558

[45] Dec. 8, 1981

[54] MARINE PROPULSION DEVICE INCLUDING PROPELLER SHROUD

[75] Inventor: Theodore J. Holtermann, Milwaukee, Wis.

[73] Assignee: Outboard Marine Corporation, Waukegan, Ill.

[21] Appl. No.: 52,802

[22] Filed: Jun. 28, 1979

[51] Int. Cl.[3] ..... B63H 1/16; B63H 21/32

[52] U.S. Cl. ..... 440/67; 440/89

[58] Field of Search ..... 115/11, 12 A, 17, 42, 115/73; 440/47, 49, 66, 67, 71, 72, 88, 89, 900

[56] References Cited

U.S. PATENT DOCUMENTS

| | | | |
|---|---|---|---|
| 2,030,375 | 2/1936 | Kort | 115/42 |
| 2,860,594 | 11/1958 | Kiekhaefer | 115/42 X |
| 2,983,246 | 5/1961 | Manley | 440/72 |
| 3,149,605 | 9/1964 | Broadwell | 115/18 |
| 3,209,534 | 10/1965 | Stallman | 115/12 A X |
| 3,249,083 | 5/1966 | Irgens | 115/12 A |
| 3,434,447 | 3/1969 | Christensen et al. | 115/73 |
| 3,476,070 | 11/1969 | Austen | 440/88 |
| 3,494,320 | 2/1970 | Stubblefield | 115/18 |
| 3,499,412 | 3/1970 | Anthes et al. | 115/42 |
| 3,508,517 | 4/1970 | Hannon | 115/42 |
| 3,624,737 | 11/1971 | Keller | 440/47 |
| 3,943,876 | 3/1976 | Kiekhaefer | 440/89 |
| 3,968,944 | 7/1976 | Zimmer et al. | 115/42 X |
| 4,096,819 | 6/1978 | Evinrude | 115/42 X |

FOREIGN PATENT DOCUMENTS

| | | | |
|---|---|---|---|
| 2323029 | 11/1974 | Fed. Rep. of Germany | 115/11 |
| 924482 | 4/1963 | United Kingdom | 115/11 |
| 1419774 | 12/1975 | United Kingdom | 115/42 |

*Primary Examiner*—Edward R. Kazenske

*Attorney, Agent, or Firm*—Michael, Best & Friedrich

[57] ABSTRACT

The marine propulsion device includes a lower unit normally submerged in water, a propeller carried by the lower unit, and an annular shroud surrounding the propeller blades and defining a passageway through which water flows. The shroud, which can be in the form of a Kort-type nozzle for augmenting propeller thrust, has a trailing edge located rearwardly of the travel path of the propeller blade tips. The trailing edge of the shroud includes an annular recess through which either engine exhaust gases or atmospheric air is delivered to ventilate the low pressure area created behind the trailing edge of the shroud during forward movement of the lower unit through water.

7 Claims, 4 Drawing Figures

MARINE PROPULSION DEVICE INCLUDING PROPELLER SHROUD

BACKGROUND OF THE INVENTION

This invention relates to marine propulsion devices and, more particularly, to marine propulsion devices, such as outboard motors, stern drive units and the like, including a shroud surrounding the propeller for augmenting propeller thrust and/or guarding the propeller against underwater obstructions.

It is known that the thrust delivered by propeller-driven marine propulsion devices can be increased by employing a so-called Kort-type shroud or nozzle which surrounds the propeller and defines a venturi-like flow passage for water. For maximum efficiency the outside shape of such a nozzle should not be greater in diameter than the opening at the entrance or mouth of the nozzle. In a nozzle designed for relatively high advance speeds this would require a thin nozzle section which may not have adequate structural strength to sustain all the loads imposed on it. Also, the aft or rear section of the nozzle should ideally taper to a thin trailing edge. However, nozzles having such a shape are vulnerable to damage upon striking underwater obstructions. As a practical compromise it usually is necessary to use a nozzle with a section which is thicker and more blunt-ended even though it results in greater fluid-dynamic drag.

Examples of Kort-type nozzle arrangements for propeller-driven marine propulsion devices are disclosed in the U.S. Kort Pat. No. 2,030,375, issued Feb. 11, 1936, the U.S. Anthes et al Pat. No. 3,499,412, issued Mar. 10, 1970 and the U.S. Hannan Pat. No. 3,508,517, issued Apr. 28, 1970. Examples of jet propelled marine propulsion devices including similar nozzle arrangements are disclosed in the U.S. Irgens Pat. No. 3,249,083, issued May 3, 1966 and the U.S. Stubblefield Pat. No. 3,494,320, issued Feb. 10, 1970. Attention is also directed to the U.S. Broadwell Pat. No. 3,149,605, issued Sept. 22, 1964, which discloses a propeller-surrounding guard arranged to also serve as a siphon for pumping water from the bottom or bilge of a boat.

SUMMARY OF THE INVENTION

The invention provides a marine propulsion device including a lower unit having a lower portion normally submerged in water, a rotatable propeller carried by the lower unit and having at least one radially extending blade, and an annular shroud surrounding the propeller blade, defining a water flow passageway and having a trailing end portion terminating in a trailing edge which is located rearwardly of the travel path of the propeller blade tips and extends transversely of the direction of travel of the lower unit. Means are provided for delivering gas to the area behind the shroud trailing edge during forward movement of the lower unit through water.

In one embodiment, the shroud is arranged as a Kort-type nozzle for augmenting propeller thrust and having a relatively blunt or generally straight trailing edge.

In another embodiment, the gas-delivering means includes an annular recess in the trailing end portion of the shroud opening rearwardly into the area behind the shroud or nozzle, and means connecting the annular recess in communication with the source of gas. Such means can include an exhaust passageway in the lower unit communicating with the engine and with the annular recess or an air intake duct located above the water and communicating with a gas passageway in the lower unit connected in communication with the annular recess.

When gas is delivered internally to the shroud recess, the aft end of the lower unit preferably is streamlined in a rearwardly direction so as to create a water barrier during forward movement of the lower unit for preventing or minimizing upward migration of gas from the shroud recess. A laterally extending anti-cavitation plate located above the shroud and having a trailing end extending rearwardly beyond the trailing edge of the shroud can be provided on the lower unit as added protection against gas leakage through the water surface.

One of the principal features of the invention is the provision of a propeller-driven marine propulsion device including a shroud or nozzle surrounding the propeller and means for minimizing drag associated with the low pressure area generated behind the trailing edge of the shroud or nozzle.

Another of the principal features of the invention is the provision of a propeller-driven marine propulsion device including a Kort-type nozzle which produces minimum drag and has adequate structural strength to also serve as a propeller guard.

A further of the principal features of the invention is the provision of a propeller-driven marine propulsion device including a Kort-type nozzle surrounding the propeller and means for delivering gas to the low pressure area created behind the trailing edge of the nozzle during movement through water.

Other features and advantages of the invention will become apparent to those skilled in the art upon reviewing the following description, the drawing and the appended claims.

Figure 1:
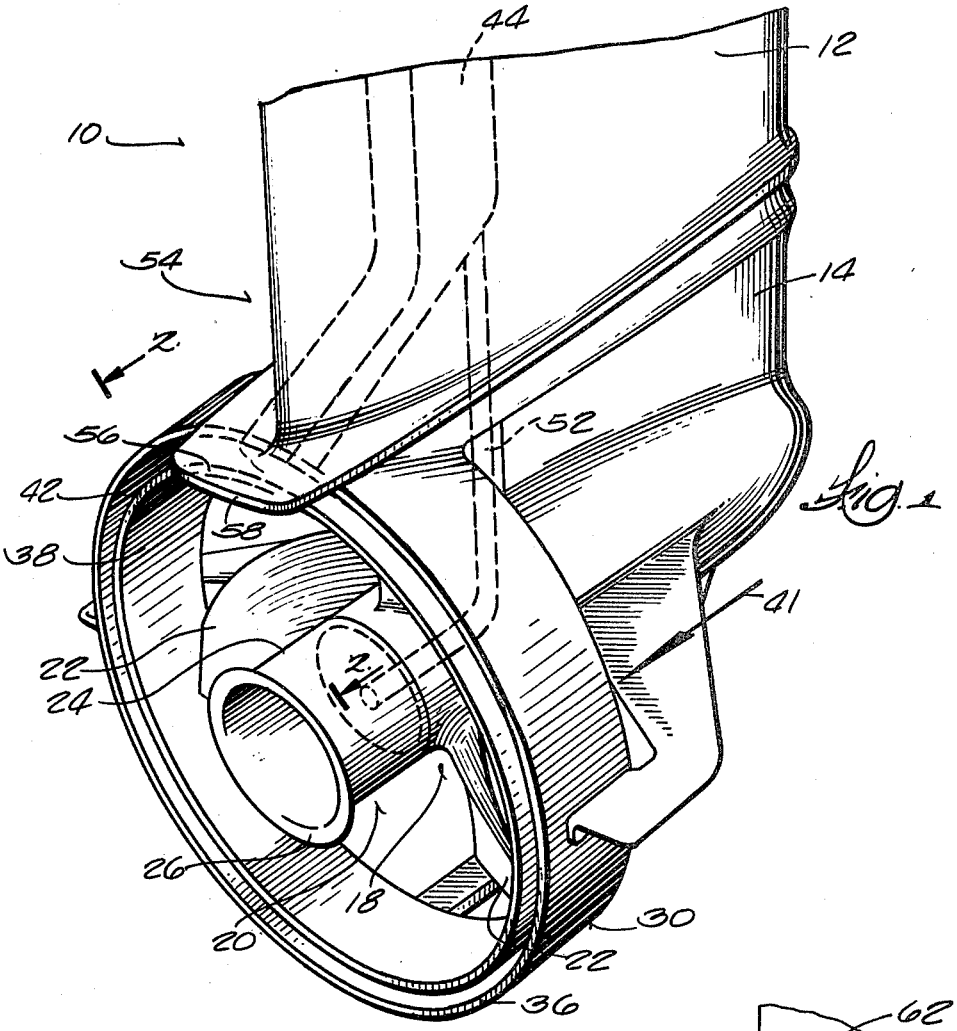
FIG. 1 is a fragmentary, perspective view, partially schematic, of a lower unit of a marine propulsion device incorporating various of the features of the invention.

Before explaining at least one embodiment of the invention in detail, it is to be understood that the invention is not limited in its application to the details of construction and the arrangements of the components set forth in the following description and illustrated in the drawing. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENTS

Illustrated fragmentarily in FIG. 1 is a marine propulsion device 10, which can be either a stern drive unit or an outboard motor, including a propulsion or lower unit 12 having a lower portion or gearcase 14 which is normally submerged in water. Rotatably mounted in the gearcase 14 is a propeller shaft (not shown) carrying a propeller 18. The propeller shaft is drivingly connected to an internal combustion engine through a suitable transmission (not shown) which can be located inside the gearcase 14. The propeller 18 includes a hub 20 and at least one series of blades 22 extending radially outwardly from the hub 20. The hub 20 includes a generally cylindrical portion 24 terminating in a radially outwardly extending flare 26. Each of the propeller blades 22 terminates in an outer tip 28 which preferably is flat as best shown in FIG. 2.

Supported from the gearcase 14 and surrounding the propeller 18 is an annular shroud or nozzle 30. While various arrangements can be used, in the specific construction illustrated, the shroud 30 is arranged to function as a Kort-type nozzle for augmenting propeller thrust. The nozzle 30 (FIG. 2) has a rounded forward or leading end portion 32 located forwardly of the circular travel path of the propeller blade tips 28 and a rear or trailing end portion 34 terminating in a blunt or generally straight trailing edge or surface 36 which is located rearwardly of the travel path of the propeller blade tips 28 and which extends transversely of the direction of travel of the lower unit 12. The interior side wall 38 of the nozzle 30 defines a water flow passageway 40 having the usual venturi-like contour of a Kort-type nozzle and through which water flows in the direction of arrow 41 during forward movement of the lower unit 12 through the water. In this regard, the inside diameter of the interior side wall 38 is somewhat larger at the water inlet or forward end of the nozzle 30 than in the vicinity of the travel path of the propeller blade tips 28 in order to provide the desired venturi effect for augmenting propeller thrust.

As the lower unit 12 moves through the water, a low pressure area is created behind or rearward of the blunt trailing edge 34 of the nozzle 30, particularly at higher boat speeds. Means are provided for delivering gas to this low pressure area. While various arrangements can be used, in the specific construction illustrated, such means includes an annular recess 42 in the trailing end portion 34 of the nozzle 30. The annular recess 42 opens rearwardly into the low pressure area, extends forwardly from the trailing edge 36, and is connected in communication with a suitable source of gas.

Figure 2:
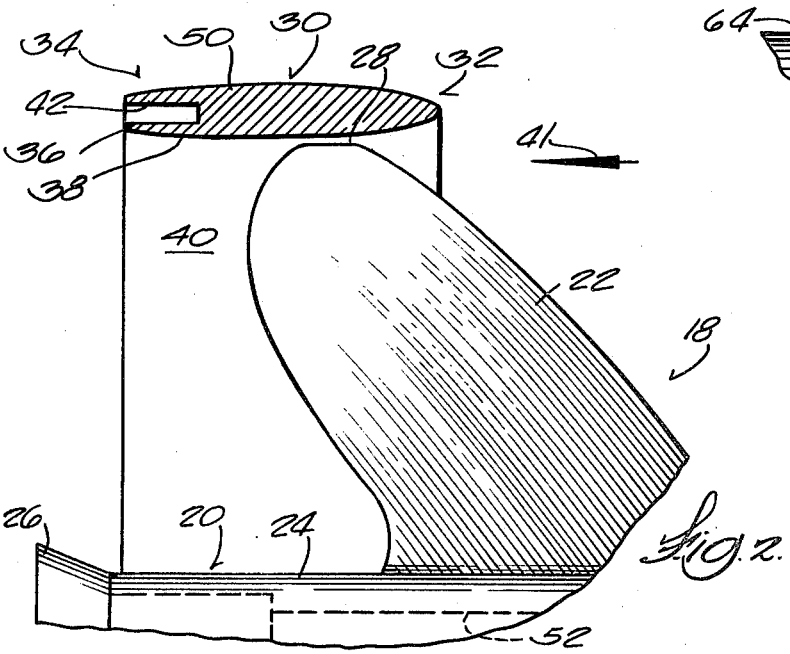
FIG. 2 is a sectional view taken generally along line 2—2 in FIG. 1.

In the embodiment illustrated in FIGS. 1 and 2, the trailing end portion 34 of the nozzle 30 has a substantially uniform thickness around the periphery and the engine exhaust gas is used as the gas source. More specifically, the lower unit 12 includes an exhaust passageway (shown schematically) which is connected in communication with the engine exhaust and in communication with the annular recess 42.

In operation, exhaust gases discharged from the engine are delivered through the annular recess 42 into the low pressure behind the trailing edge 36 of the nozzle 30 to thereby ventilate this area and reduce drag on the marine propulsion device 10. This reduction in drag ultimately results in an increase in the thrust delivered by the marine propulsion device.

The portion of the exterior side wall 50 of the nozzle 30 extending from the rounded leading end portion 32 to the trailing edge 36 preferably is slightly tapered inwardly and rearwardly, as shown in FIG. 2, to provide some pressure recovery.

The nozzle 30, in addition to augmenting propeller thrust, also serves as a guard for protecting the propeller 18 from being damaged by underwater obstructions. The nozzle 30 should have a reasonably thick cross section throughout its entire length in order to have adequate structural stength to best serve this purpose and/or to withstand the normal loads imposed on the nozzle during operation. Since the drag normally produced by a blunt trailing edge is minimized, as described above, the trailing end portion 34 of the nozzle 30 can have a cross sectional thickness which is substantially greater than that of the thin streamlined rear sections of conventional nozzles without producing an appreciable increase in drag. If desired, the cross sectional thickness of the nozzle 30 can be substantially uniform along the entire length of the nozzle, except for the rounded leading end portion 32. Also, the portion of the exterior side wall 50 extending from the leading end portion to the trailing edge 36 can have a smooth cylindrical shape and extend in a generally straight line substantially parallel to the direction of travel of the lower unit 12. While the above-described internal and external contours of the nozzle are generally preferred for the reasons given, various other customary contours for Kort-type nozzles can be used to obtain optimum pressure effects for the particular propeller design and operating conditions.

The exhaust passageway 44 can be arranged so that a portion of the engine exhaust gases is delivered to and ventilates the low pressure area or hub vortex created behind the propeller hub 20 during propeller rotation. In the specific construction illustrated in FIGS. 1 and 2, the exhaust passageway 44 includes a duct 52 which is shown schematically and which extends axially through the propeller hub 20. For some applications, it may not be necessary to ventilate the hub vortex and the propeller hub 20 can be provided with a streamlined fairing in place of the flare 26.

Means are provided for preventing or minimizing leakage of gases from the nozzle recess 42, through the water and to the atmosphere. In the specific construction illustrated in FIG. 1, such means includes rearwardly streamlining the aft or trailing end 54 of the lower unit 12 above the nozzle 30 and in the vicinity of the water line. With this arrangement, the water, as the lower unit 12 is moved forwardly therethrough, converges or closes in behind the trailing end 54 above the nozzle 30 and acts as a barrier for preventing upward migration of gases from the nozzle recess 42 to the atmosphere.

Further protection against gas leakage from the nozzle recess 42 through the water surface can be provided by an anti-cavitation plate 56 which extends laterally from the upper unit 12 above the nozzle 30 and has a trailing end 58 which extends rearwardly beyond the trailing edge 36 of the nozzle 30 below the water line. The anti-cavitation plate 56 is adapted to minimize the formation of voids in the water flow pattern behind the trailing end 54 of lower unit 12 through which gases might escape from the nozzle recess 42 to the atmosphere.

Figure 3:
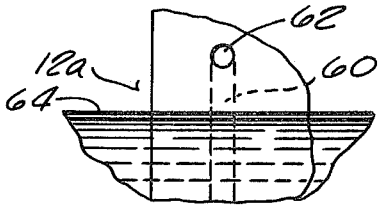
FIG. 3 is a fragmentary elevational view of an alternate arrangement for the gas-delivering means.

In the alternate construction illustrated in FIG. 3, atmospheric air is used as the gas for ventilating the low pressure area behind the trailing edge 36 of the nozzle 30. The lower unit **12*a* includes an air or gas passageway 60 communicating with the annular recess 42 and communicating with an air intake port or duct 62 located above the water level 64. Due to the subatmospheric pressure condition created in the area behind the trailing edge of the nozzle, air at atmospheric pressure is aspirated thereinto through the air intake duct 62, the gas passageway 60, and the annular recess 42**.

Figure 4:
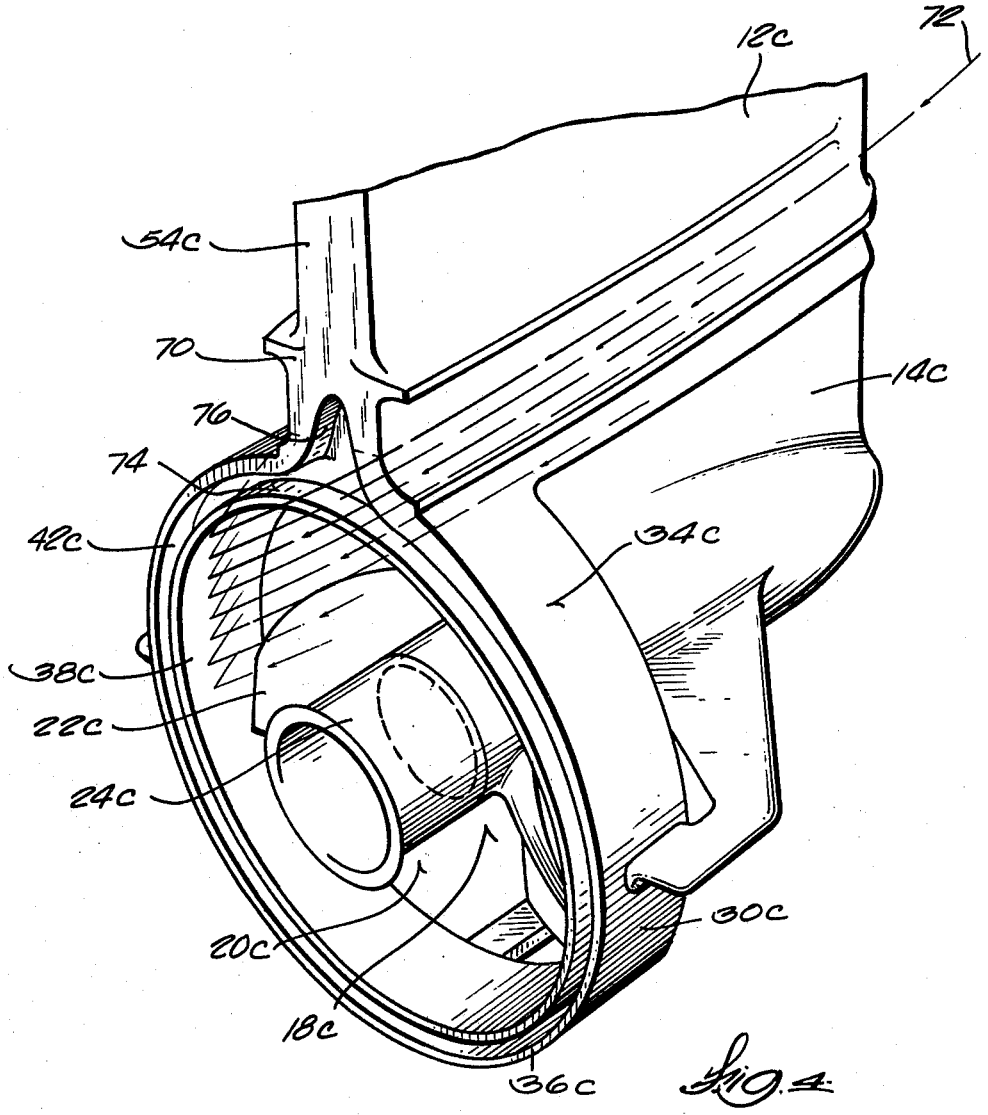
FIG. 4 is a fragmentary, perspective view similar to FIG. 1 illustrating an alternate construction which is arranged to facilitate an external flow of atmospheric air.

In the alternate construction illustrated in FIG. 4, atmospheric air flows directly to the nozzle recess 42*c*, i.e., internal ducting is eliminated. More specifically, a blunt surface 70, which extends transversely of the direction of travel of the lower unit 12*c*, is provided on the aft or trailing end portion 54*c* of the lower unit 12*c* above the nozzle 30*c* and in the vicinity of the water line (designated by reference numeral 72). As the lower unit 12*c* is moved forwardly through the water, a void area (designated by reference numeral 74), which breaks the water surface, is created behind the blunt surface 70 as illustrated. Atmospheric air can flow downwardly through the void area 74 toward the lower pressure area existing behind the trailing edge 36*c* of the nozzle 30*c*.

As illustrated, the trailing end portion 34*c* of the nozzle 30*c* preferably is tapered in thickness around the periphery, with a thicker cross section at the top and a thinner cross section at the bottom. This creates a larger low pressure area communicating with the void area 74 for facilitating flow of atmospheric air into and around the periphery of the nozzle recess 42*c*. The blunt surface 70 can be provided with a forwardly extending recess 76 opening into the nozzle recess 42*c* to further facilitate flow of atmospheric air into the nozzle recess 42*c*.

While the gas-delivering means has been described in connection with a Kort-type nozzle arranged to augment propeller thrust, it can be used to reduce the drag produced at the trailing edge of shrouds designed to serve only as a propeller guard.

Various of the features of the invention are set forth in the following claims:

I claim:

1. A marine propulsion device including an engine, a lower unit having a lower portion normally submerged in water and including an exhaust gas passageway communicating with said engine, a rotatable propeller carried by said lower unit, driven by said engine, and having at least one radially extending blade terminating in an outer tip, an annular Kort-type nozzle surrounding said propeller and defining a venturi-like passageway through which water flows to augment propeller thrust, said nozzle having a trailing end portion terminating in a blunt trailing surface which is located rearwardly of the propeller blade tip travel path and extends transversely of the direction of travel of said lower unit, means for delivering gas from said gas passageway to the area behind said nozzle trailing surface including an annular recess in said nozzle trailing end portion opening rearwardly into the area behind said nozzle, extending forwardly from said nozzle trailing surface, and communicating with said gas passageway, and an anti-cavitation plate on said lower portion located above said nozzle and extending rearwardly beyond said nozzle trailing surfaces for minimizing upward migration of gas from said annular recess.

2. A marine propulsion device according to claim 1 including a propeller hub having a cylindrical portion rearwardly terminating in a radially outwardly extending flare.

3. A marine propulsion device according to claim 1 wherein said nozzle includes a leading end portion having a rounded leading edge and an exterior side wall which tapers inwardly and rearwardly from said leading end portion.

4. A marine propulsion device including a lower unit having a lower portion normally submerged in water and having an aft end portion, a rotatable propeller carried by said lower unit, and having at least one radially extending blade terminating in an outer tip, an annular Kort-type nozzle surrounding said propeller and defining a venturi-like passageway through which water flows to augment propeller thrust, said nozzle having a trailing end portion terminating in a blunt trailing surface which is located rearwardly of the propeller blade tip travel path and extends transversely of the direction of travel of said lower unit, and means for delivering gas to the area behind said nozzle trailing surface including an annular recess in said nozzle trailing end portion opening rearwardly into the area behind said nozzle and extending forwardly from said nozzle trailing surface, and further including a blunt surface on said aft end portion located above and merging with said trailing surface of said nozzle and extending transversely of the direction of travel of said lower unit for creating, during forward movement of said lower unit through water, a void area located in the water behind said aft end portion and communicating with the atmosphere and with said annular recess for affording supply of gas to said annular recess from the atmosphere.

5. A marine propulsion device including a lower unit having a lower portion normally submerged in water and having an aft end portion, a rotatable propeller carried by said lower unit, and having at least one radially extending blade terminating in an outer tip, a generally annular nozzle coaxial with and surrounding said propeller, said nozzle having a trailing end portion terminating in a blunt trailing surface which is located rearwardly of the propeller blade tip travel path and which extends transversely of the direction of travel of said lower unit, and means for delivering gas to the area behind said nozzle trailing surface including an annular recess in said nozzle trailing end portion opening rearwardly into the area behind said nozzle and extending forwardly from said nozzle trailing surface, and further including a blunt surface on said aft end portion located above and merging with said trailing surface of said nozzle and extending transversely of the direction of travel of said lower unit for creating, during forward movement of said lower unit through water, a void area located in the water behind said aft end portion and communicating with the atmosphere and with said annular recess for affording supply of gas to said annular recess from the atmosphere.

6. A marine propulsion device according to either claim 4 or 5 wherein said nozzle has top and bottom portions and wherein the cross-section thickness of said nozzle is substantially greater at the top than at the bottom.

7. A marine propulsion device according to either claim 4 or 5 and including a propeller hub having a cylindrical portion rearwardly terminating in a radially outwardly extending flare.

* * * * *